United States Patent [19]

Saier et al.

[11] 4,168,618

[45] Sep. 25, 1979

[54] Y AND T-FINNED TUBES AND METHODS AND APPARATUS FOR THEIR MAKING

[75] Inventors: Manfred Saier, Wullenstetten; Hans-Werner Kaštner, Vöhringen; Robert Klöckler, Tiefenbach, all of Fed. Rep. of Germany

[73] Assignee: Wieland-Werke Aktiengesellschaft, Postfach, Fed. Rep. of Germany

[21] Appl. No.: 922,889

[22] Filed: Jul. 7, 1978

[30] Foreign Application Priority Data

Jan. 26, 1978 [DE] Fed. Rep. of Germany ..... 2803273
Jan. 26, 1978 [DE] Fed. Rep. of Germany ..... 2803274

[51] Int. Cl.[2] ..... B21D 53/06; B21H 3/00

[52] U.S. Cl. ..... 72/71; 72/79; 72/98; 29/157.3 AH; 165/184

[58] Field of Search ..... 72/68, 71, 78, 98; 165/133, 181, 183, 184, 185; 29/157.3 R, 157.3 A, 157.3 AH, 157.3 B

[56] References Cited

U.S. PATENT DOCUMENTS

| | | | |
|---|---|---|---|
| 3,326,283 | 6/1967 | Ware | 165/184 |
| 3,383,892 | 5/1968 | Brothen | 29/157.3 AH |
| 3,753,364 | 8/1973 | Runyan et al. | 29/157.3 AH |
| 3,768,290 | 10/1973 | Zatell | 29/157.3 B |
| 3,887,004 | 6/1975 | Beck | 29/157.3 A |
| 4,004,441 | 1/1977 | Leszak | 165/133 |

*Primary Examiner*—Lowell A. Larson
*Attorney, Agent, or Firm*—Ladas, Parry, Von Gehr, Goldsmith & Deschamps

[57] ABSTRACT

This invention concerns finned tubes for use in heat exchanging whereby the fins have a generally T or Y shape. There is disclosed process and apparatus for making these Y and T-finned tubes whereby a smooth tube is subjected to a rolling process with notching rollers being arranged between rolling discs. Bending rollers can be used to form Y fins and, if desired these can be subsequently flattened into T-fins.

36 Claims, 11 Drawing Figures

Y AND T-FINNED TUBES AND METHODS AND APPARATUS FOR THEIR MAKING

BACKGROUND OF THE INVENTION

1. Field of the Invention

This invention concerns tubes used in heat exchangers which are finned in order to increase their heat exchanging properties as well as a method and apparatus for rolling finned tubes and subsequently working the fins to obtain a Y or T shape.

2. Description of the Prior Art

Finned tubes are known generally in the art. For example, German Offenlegungschrift No. 1501656 shows a finned tube in which the fins have indentations provided in the fins at their outer circumference. Such tubes are beset with difficulties in storage and transport as well as in installation of the tube into tube plates and into support washers which are used in mounting the tubes in heat exchangers. Furthermore, the use of such tubes in tube bundle evaporators can be troublesome since the crevices between adjoining fins of the tubes which are located in relatively high positions of the evaporators tend to collect bubbles rising from below. These bubbles lodge in these crevices and prevent an optimum heat exchanging operation. The rising bubbles are able to enter into the relatively wide openings in the crevices between adjoining indentations and thereby prevent the evaporation surfaces from making optimum contact with the liquid.

U.S. Pat. No. 3,299,949 shows a power vacuum tube having longitudinal T-formed fins used for cooling. These tubes must, however, be arranged in a perpendicular fashion in order to utilize the so-called "thermo syphon effect." A utilization of this principal in regard to evaporators consisting of bundles of tubes is not possible since in regard to these evaporators the tubes must be arranged horizontally.

BRIEF SUMMARY OF THE INVENTION

According to the invention there are provided Y and T-finned tubes wherein the mechanical characteristics, the heat exchanging characteristics and the ease of handling characteristics are improved. The Y and T-fins circle the tube in a continuous unbroken fashion with the gap between adjacent fins being narrowed and being uniform about the circumference of the tube.

According to a first embodiment of the invention, there is provided method and apparatus for fabricating the inventive T tube; according to a second embodiment of the invention, this first method and apparatus is modified so as to fabricate an inventive Y-finned tube.

The finned tubes constructed in accordance with this invention present substantial advantages over state of the art finned tubes, in regard to mechanical characteristics, heat exchanging characteristics and ease of handling characteristics.

Both the Y and T tubes constructed in accordance with the teachings of this invention include Y or T-fins which encircle the tube in a continuous unbroken fashion with the ends of the Y or T formed fins approaching each other and thereby forming a relatively narrow gap between the top portions of adjacent fins with a relatively wider chamber between adjacent fins lying below this narrow gap.

In this manner, particularly in the T-fins, one obtains a tube with a seemingly smooth circumferential surface on which tubes are easily stacked, one on the other, are easily transported, and are easier to insert into tube plates or other fixtures. The difference between the outer diameter of the un-finned ends and the fin diameter is a multiple larger than in the case of normal finned tubes.

Finned tubes of this sort have important further advantages over known tubes.

The outer ends of the fins, which, in the case of normal finned tubes, are partially rough and to some extent include cracks and splits, are, in the T-tubes constructed according to the invention, solid and smoothly machined, the tubes will have fewer indentations on their surface and will, therefore, be better able to withstand mechanical alternating stress. A propagation of cracks in the tube will be thereby limited.

The heat exchange function according to the disclosed T and Y tubes is improved in regard to the evaporation process since the evaporation of fluids largely takes place in the hollow chambers between the T or Y formed fins. The evaporated fluid will be continually replaced by the fluid which enters the crevice between two adjoining fins. The formation of bubbles will not be interrupted since small bubbles will be able to detach themselves continuously; there will always remain bubbles in the hollow chambers so that new bubbles can be continuously formed and the nucleation energy will remain minimal (see German Pat. No. 1551542).

Particularly in the case when tubes constructed in accordance with this invention are used with tube bundle type evaporators, rising bubbles will be prevented from entering into the crevices between the fins of the tubes which are placed in relatively higher positions. These rising expanding bubbles will rather roll past these higher placed tubes so that the surfaces of these tubes will remain completely usable for evaporation purposes.

According to the invention, the distance between adjacent fins in the radial direction proceeding from the tube wall outwards first increases and then this distance between the fins decreases as one approaches the ends of the fins. This increase and then decrease in the distance between adjacent fins occurs preferably in a continual manner.

The T or Y-fins are constructed so that the fins run in a single or multiple threaded fashion and in a spiral or helical fashion about the circumference of the tube. It is well known in the art that one can obtain a multiple threaded arrangement by increasing the angle, by integral multiples, between the rolling tool and the tube upon which the threading operation is being carried out. In order to obtain good heat exchange characteristics, it is recommended that there be arranged at least two fins per centimeter, preferably two to twenty fins per centimeter, with the upper crevice width being at least 0.1 mm and preferably 0.1 to 1.0 mm.

Favorable conditions in regard to heat transfer properties and solidity of the tubes can be obtained if the relation between the largest crevice width to the corresponding fin width at the same distance from the middle axis of the tube lies in the area between 1:1 and 5:1.

It is also an object of this invention to provide a process for manufacturing the Y and T tubes according to the invention.

The usual process for forming finned tubes is shown in U.S. Pat. No. 3,327,512 in which the fin material is obtained by means of displacement of the material making up the tube wall, which material is displaced in an outward direction by means of a rolling process and that the tube, by means of the rolling energy, is either both placed in rotation and pushed or only pushed according to the formed fins whereby fins with increasing height are formed from the otherwise unformed smooth tube wall.

The inventive process is characterized in that the ends of the fins during formation are notched in the circumferential direction of the tube so that the ends of the notched fins at the termination of the forming process appear to lie flat along the surface of an imaginary cylinder which is co-axial with the tube middle axis. The ends of the fins, after being notched, are bent to the side to form Y-fins. If desired the Y-fins are then forced into a T-form by means of inwardly directed radial pressure.

There will be, therefore, a middle step wherein the tube is formed with Y-shaped fins before the T-shaped finned tube is obtained from the Y-finned tube.

The advantage of the process is that the notching of the fins during formation occurs while the fins are supported from the sides by the rolling discs and, therefore, a breaking of the fins is avoided. In this manner the notching procedure can be carried out without difficulties even in the case of thin and high fins, The final flattening operation which is used when T-fins are formed functions also as a tube straightening operation in that the flattening operation causes the tube to become exceptionally straight. The known dangers of injury from sharp and raw fin edges, which occur when one works with such tubes, will be substantially reduced.

It is well-known that the inner surface of a tube will become uneven and wavy when the tube is subjected to a rolling operation, this waviness increasing as the strength of the tube walls decreases. This waviness which is caused by the radial pressures during the rolling of the fins, will, by means of the flattening operation, be decreased. One achieves, therefore, an inner surface of the tube which will have substantially less impediment to the flow of fluids contained therein.

By means of the process according to this invention, any pronounced distortion in the shape of the base of the fins is avoided. The area between the fins will contain similarly shaped hollow chambers and the crevice width between two fins will be relatively constant. The hollow chamber between two fins as well as the crevice gaps will be variable in a defined and continuous manner.

The apparatus for carrying out the process for making Y and/or T tubes according to the invention can be constructed so that the tube will rotate relative to a fixed rolling head or so that the rolling head will rotate about a fixed tube, that is, a tube which moves only in the axial direction and does not rotate.

An apparatus having a rotating tube is shown in U.S. Pat. No. 3,327,512. There is shown a finned tubing wherein there are at least two radially adjustable tool holders arranged at the circumference of the tube in staggered relation to each other and located in a fixed rolling head, each tool holder including a driven rolling tool including a plurality of rolling discs, the rolling tool having an axis which is at a skew angle to the tube axis.

According to the invention, this said apparatus is modified so that in the rolling tools, between the rolling discs, there are arranged notching rollers, and that, in at least one tool holder, a bending roller follows the rolling tool and that, in the case of T-fins, in at least one tool holder there is arranged a cylindrical flattening roller, whose distance from the rolling tool corresponds to at least the thickness of the bending roller. If Y-fins are desired, there would be no flattening rollers present.

In the case of a revolving rolling head one would use an apparatus having at least two radially adjustable tool holders arranged at the circumference of the tube in staggered relation to each other and located in a rolling head, each tool holder including a rolling tool including a plurality of rolling discs, the rolling tool having an axis which is at a skew angle to the tube axis whereby the rolling head is rotatably mounted and drivable in the circumferential direction of the tube.

Such an apparatus, i.e., a revolving head apparatus, modified according to the invention would have notching rollers in the rolling tool between the rolling discs and in at least one tool holder a bending roller following the rolling tool and that, if T-fins were desired, in at least one tool holder there would also be arranged a cylindrical flattening roller whose distance from the rolling tool is at least the thickness of the bending roller. In addition, a clamping holder for the tube would also be provided whether Y or T-fins were desired.

The clamping holder carries out the axial movement of the tube whereby it is either pulled by the forward portion of the tube or is moved by means of its own driving force.

In order that the middle of the fins be contacted by the notching roller during the notching process, the fin spacing corresponds preferably to the sum of the thicknesses of the rolling disc and neighboring notching roller. (Fin spacing equals distance from fin middle to fin middle.)

In order to obtain relatively thin fins, it is recommendable that the thickness of the rolling disc be greater than the thickness of the notching roller. If a relatively thick fin is desired, the thickness of the rolling disc should be smaller or equal to the thickness of the notching roller.

In the case where there are arranged notching rollers along the entire length of the rolling tool, the diameter of the notching rollers should increase as the diameter of the rolling discs increases.

Pursuant to a particular embodiment of the invention, the notching rollers are arranged only in the final rolling area of the rolling tool. It is here necessary that the thickness of the rolling discs in the initial area corresponds to the fin spacing. Since in the final rolling area the sum of the thicknesses of the rolling discs and neighboring notching roller corresponds as well to the fin spacing, it is preferable to include a correction disc between the initial and final rolling areas, the thickness of which corresponds to half the thickness of the notching roller. The notching rollers have preferably the same diameters.

In order to guarantee a trouble free notching of the fins, it is advantageous if the notching angle of the notching roller corresponds at least to double the flank angle of the last rolling disc.

According to a further preferred embodiment of the invention, the middle of the bending roller is arranged at a distance corresponding to 1.5 of the fin spacing from the middle of the last rolling disc, so that ends of the notched fins will be bent to the side by a bending roller. This distance can also be increased by an integral multiple of the fin spacing.

It is recommendable to arrange a distance disc between the rolling tool and the bending roller depending upon the thickness of the bending roller. In this manner, the bending roller and the cylindrical flattening roller have a thickness which corresponds approximately to the fin spacing.

According to a preferred embodiment of the invention, there are three tool holders spaced from one another at 120° angles.

The Y-formed fins are constructed with the bending rollers arranged around the tube as follows: Proceeding in the direction of rotation of the tube, the first bending roller will have a bending angle between 60° and 100°, the second bending roller will have a bending angle between 80° and 130°. A third bending roller is not necessary in order to form the Y-shaped fins and, if T-fins are desired, in the place of a third bending roller one can include a flattening roller, the diameter of which should correspond to that of the last notching roller. If Y-fins are desired, there would be no flattening roller necessary.

The invention is not limited to single threaded finned tube rolling. In the case of multiple threaded rolling, there would be provided for each rolling tool holder rolling discs, notching rollers, bending rollers and flattening rollers corresponding to the wished multiple of the threading of the tube.

The invention will be described in greater detail in regard to the following preferred embodiments.

Figure 1:
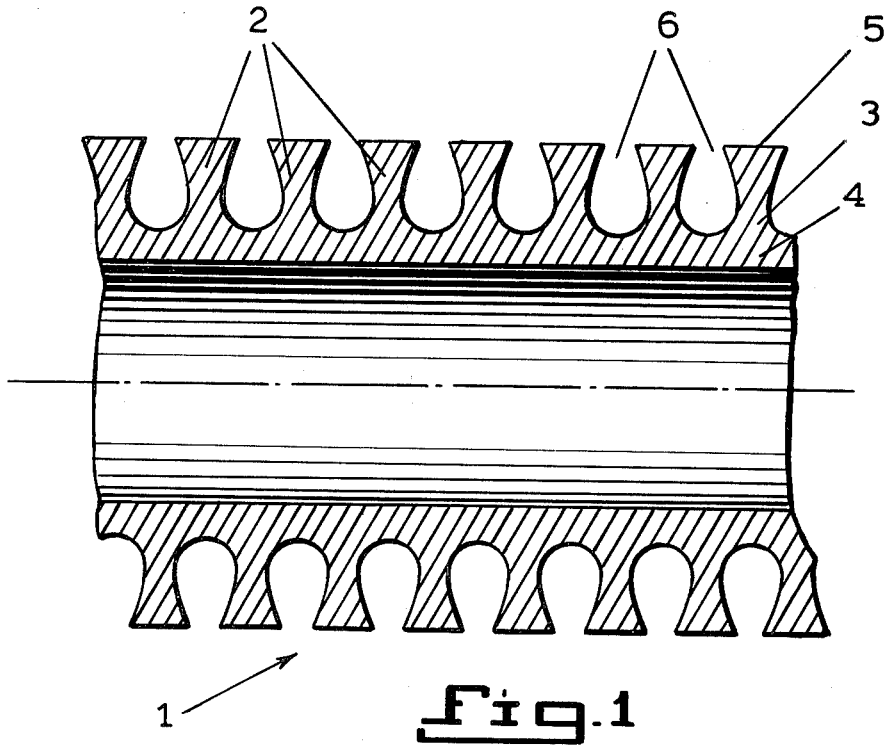
FIG. 1 shows a longitudinal section of the inventive T-finned tube.
Figure 2:
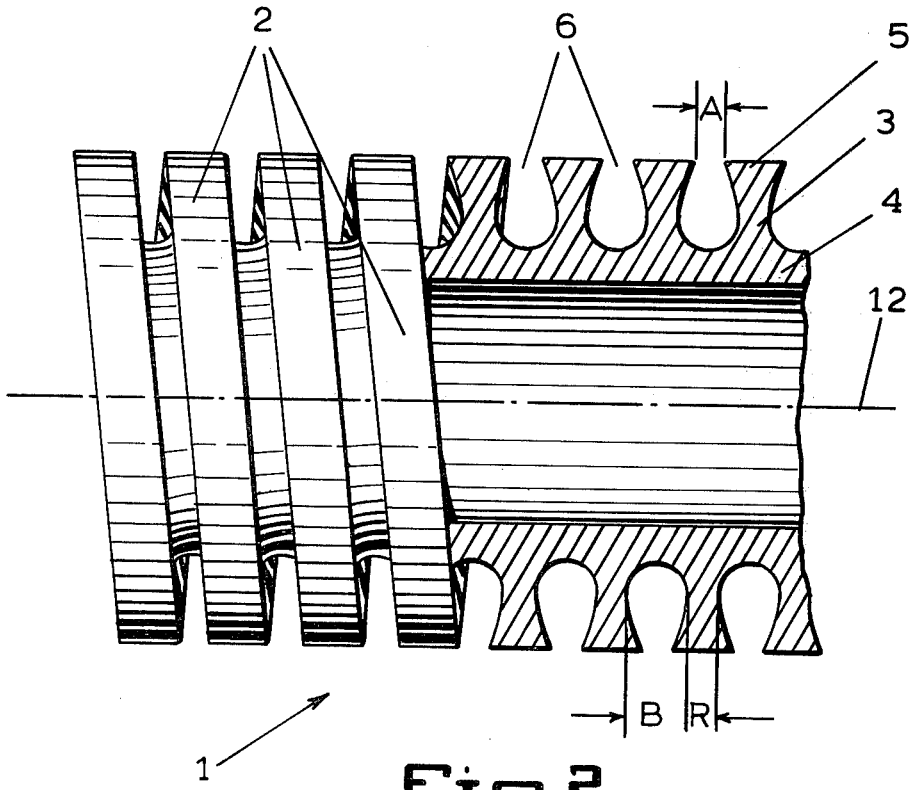
FIG. 2 shows a partial section of the finned tube.

Referring to FIGS. 1 and 2, there is shown a finned tube 1 longitudinal section (FIG. 1) and partial section (FIG. 2). The T-formed fins 2 run circumferentially in a helical or spiral fashion. The base 3 of the fins 2 is extending in the radial direction from the tube wall 4 while the fin ends 5 are forced into a T-form so that a narrowed crevice 6 is formed (see the upper crevice width A in FIG. 2). The distance between adjacent fins 2 varies continuously forming an essentially rounded hollow chamber between adjacent fins 2. The largest crevice width is indicated in FIG. 2 by B, the corresponding fin width at the same distance from the tube middle axis 12 is indicated with R.

Figure 3:
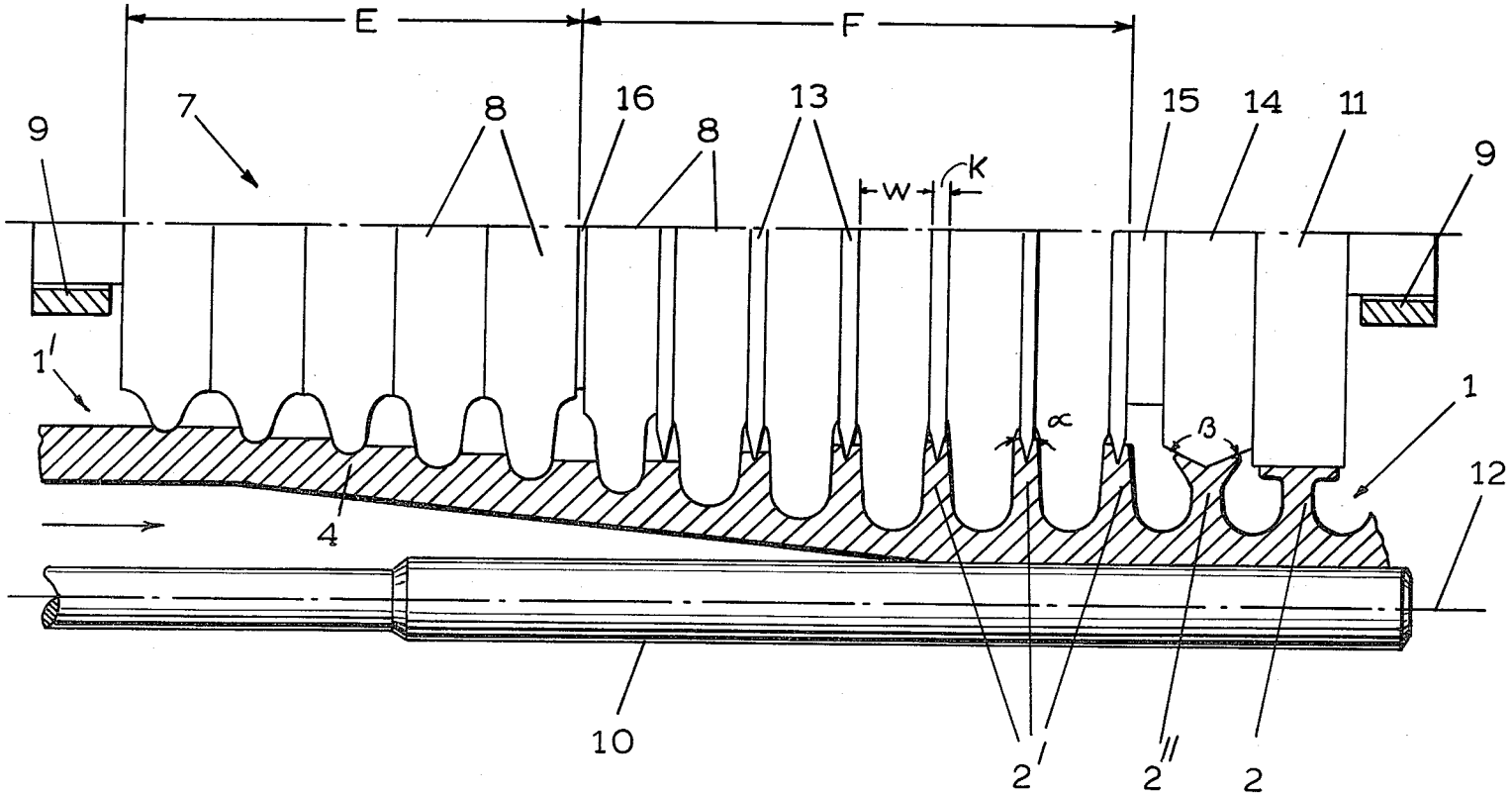
FIG. 3 shows an apparatus for the manufacture of a T-finned tube from a Y-finned tube.

FIG. 3 shows an apparatus for constructing a T-finned tube 1. This apparatus can be used with a rotating tube or with a rotating roller head.

The functioning of the apparatus in conjunction with a rotating tube and single threaded rolling process will now be explained.

Figure 5:
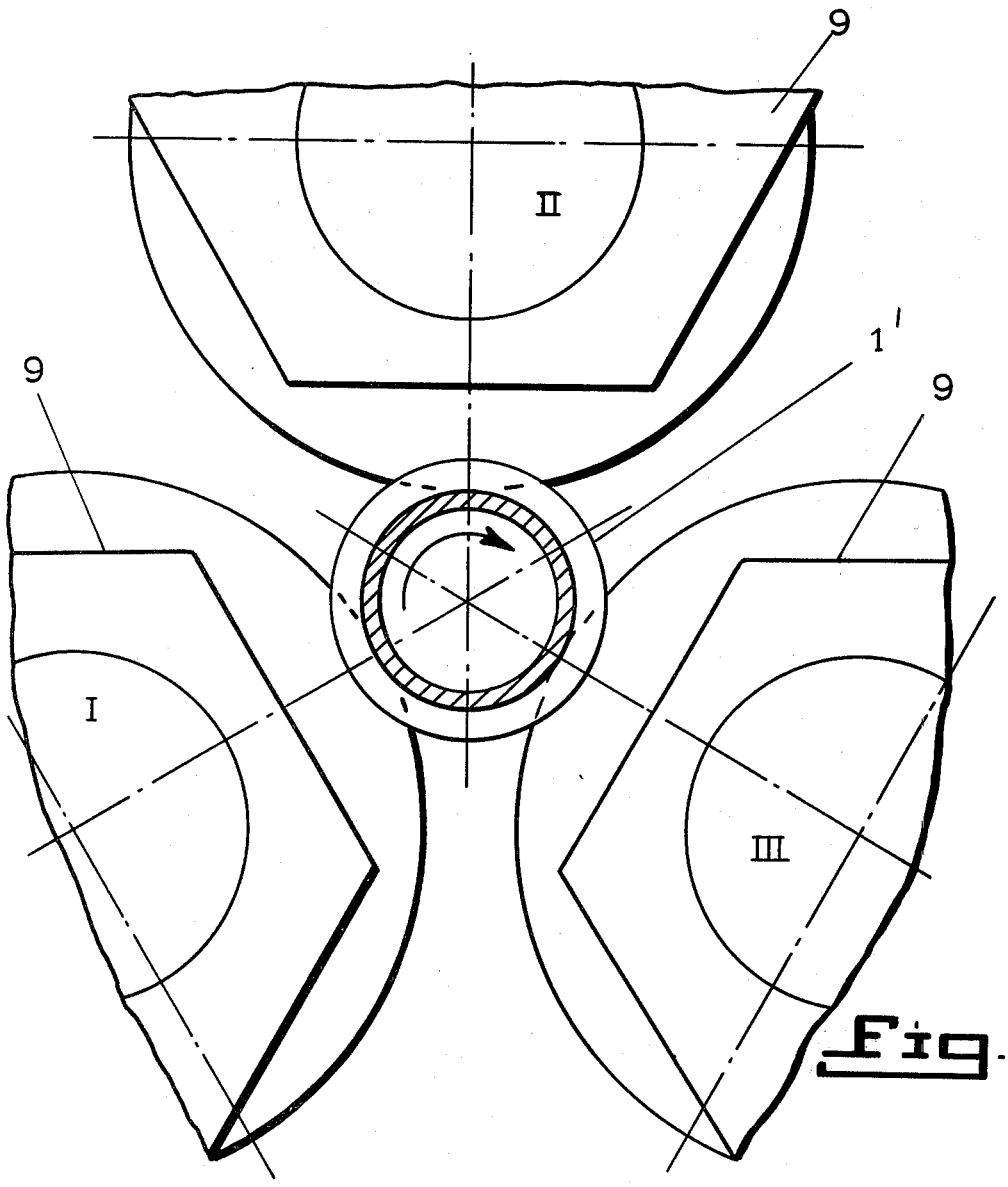
FIG. 5 shows a schematic representation of the tool holders used in FIG. 3.

Referring to the apparatus of FIG. 3, there is shown a rolling tool 7, a bending roller 14 and a cylindrical flattening roller 11, integrated into a tool holder 8 (FIG. 3 shows only a single tool holder 9). FIG. 5 shows two further tool holders 9, each displaced 120° from each other about the circumference of the tube 1. The tool holders 9 are radially adjustable. One could use, for example, 4 or 6 tool holders 9. The tool holders 9 are arranged in a fixed rolling head which is not shown in the figures.

The smooth tube 1' will be placed in rotation by the rolling tools 7 which are arranged at the circumference of the tube 1'. The axis of the rolling tools 7 will be at a skew angle to the axis of the tube. The arrow shown in FIG. 5 indicates the direction of circumferential movement of tube 1'.

The rolling tools 7 consist of a plurality of rolling discs 8 which are arranged adjacent each other and between these are arranged notching rollers 13 in the final rolling area F.

The centrally arranged rolling discs 8 form the fins 2' in a known manner from the tube wall 4 which is supported by mandrel 10. In this manner there is first performed a reduction in the diameter of the tube along the leading portion of the tube in the initial area E. In the following section of the tube (final rolling area F) there will then follow the machining of the spiral formed circumferentially running fins 2'.

Figure 6:
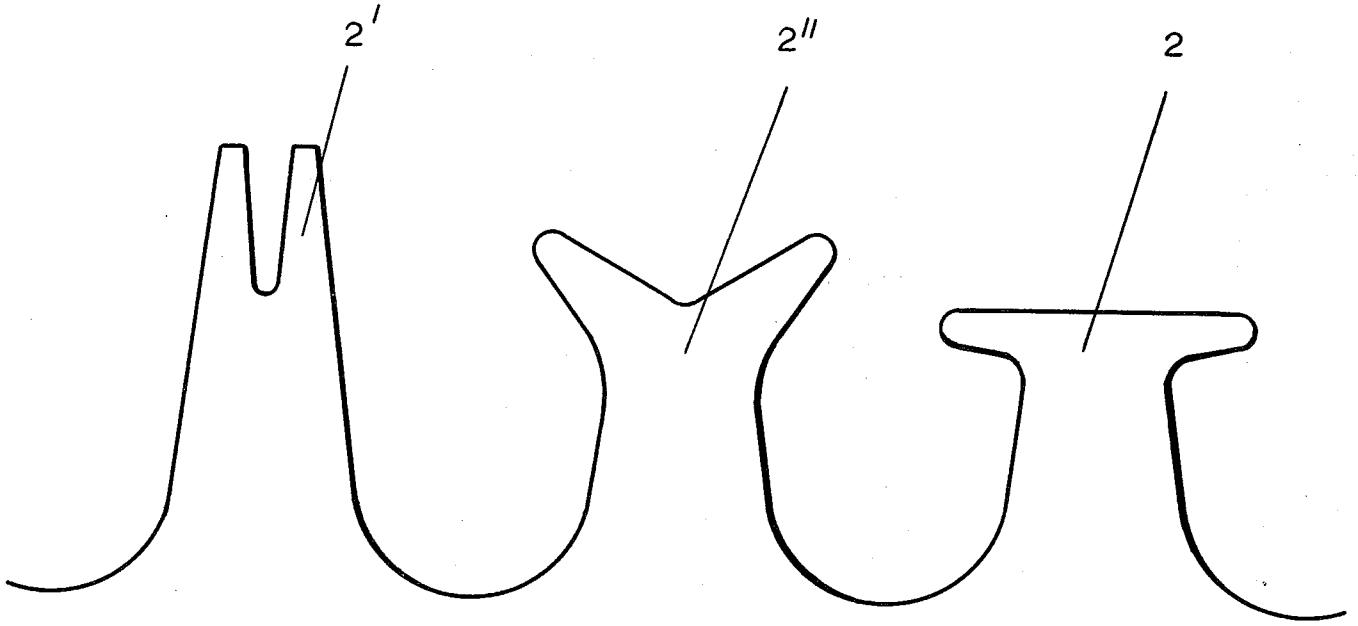
FIG. 6 depicts the formation of the fins produced by the apparatus of FIGS. 3 to 5.

By means of the notching rollers 13, there will be obtained simultaneously the notching of the ends of the fins 2' in the circumferential direction of the tube 1 so that the ends of the notched fins 2' lie along an imaginary cylinder surface which would be co-axial with the tube middle axis 12. The following bending roller 14 bends the fins 2' in a sideward direction so that Y-formed fins 2'' result which by means of flattening roller 11 are flattened in the radial direction to T-formed fins 2 (see FIG. 6).

The following preferred embodiment dimensions are given which would correspond to the working of a smooth tube having 19 mm outer diameter and a 1.45 mm wall thickness.

First of all one would form the fins 2' by means of approximately 25 rolling discs 8 (this number of discs not being shown in the drawings for ease of understanding of drawings). The diameter of the rolling discs 8 is approximately 50 mm and increases in the direction of the arrow as depicted in FIG. 3. As the diameter of the rolling discs increases, the radius of the apex of the rolling discs 8 will become larger and the flank angle $\gamma$ smaller. Corresponding to the desired fin spacing of 1.35 mm, the rolling discs are approximately 1.3 mm thick.

Figure 4:
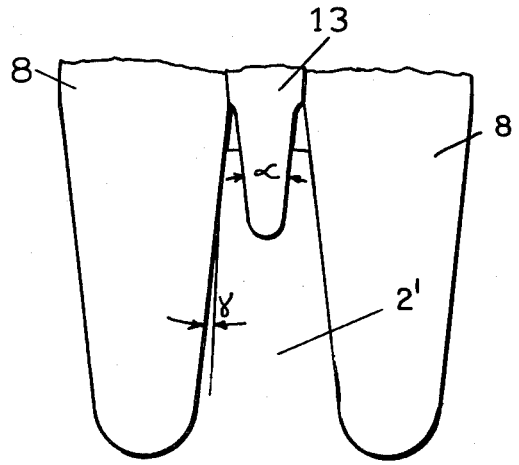
FIG. 4 shows a detail of FIG. 3.

In the final rolling area F, there are up to fifteen notching rollers arranged between the rolling discs 8 (only six are shown). These notching rollers have the same diameter. The diameter is approximately 2 mm smaller than the diameter of the last rolling disc. The notching angle $\alpha$ is approximately the double of the flank angle $\gamma$ of the last rolling disc 8, that is approximately 5° to 6° (see FIG. 4).

In accordance with the requirement that, in the final rolling area F, the sum of the thickness W of a rolling disc 8 and the thickness K of a neighboring notching roller 13 corresponds to the fin spacing $t_r$, the rolling discs 8 are 0.9 mm thick and the notching rollers 13 are 0.4 mm thick. For compensation there is arranged between the initial area E and the final rolling area F, a correction disc 16 having a thickness of $K/2=0.2$ mm.

Figure 7:
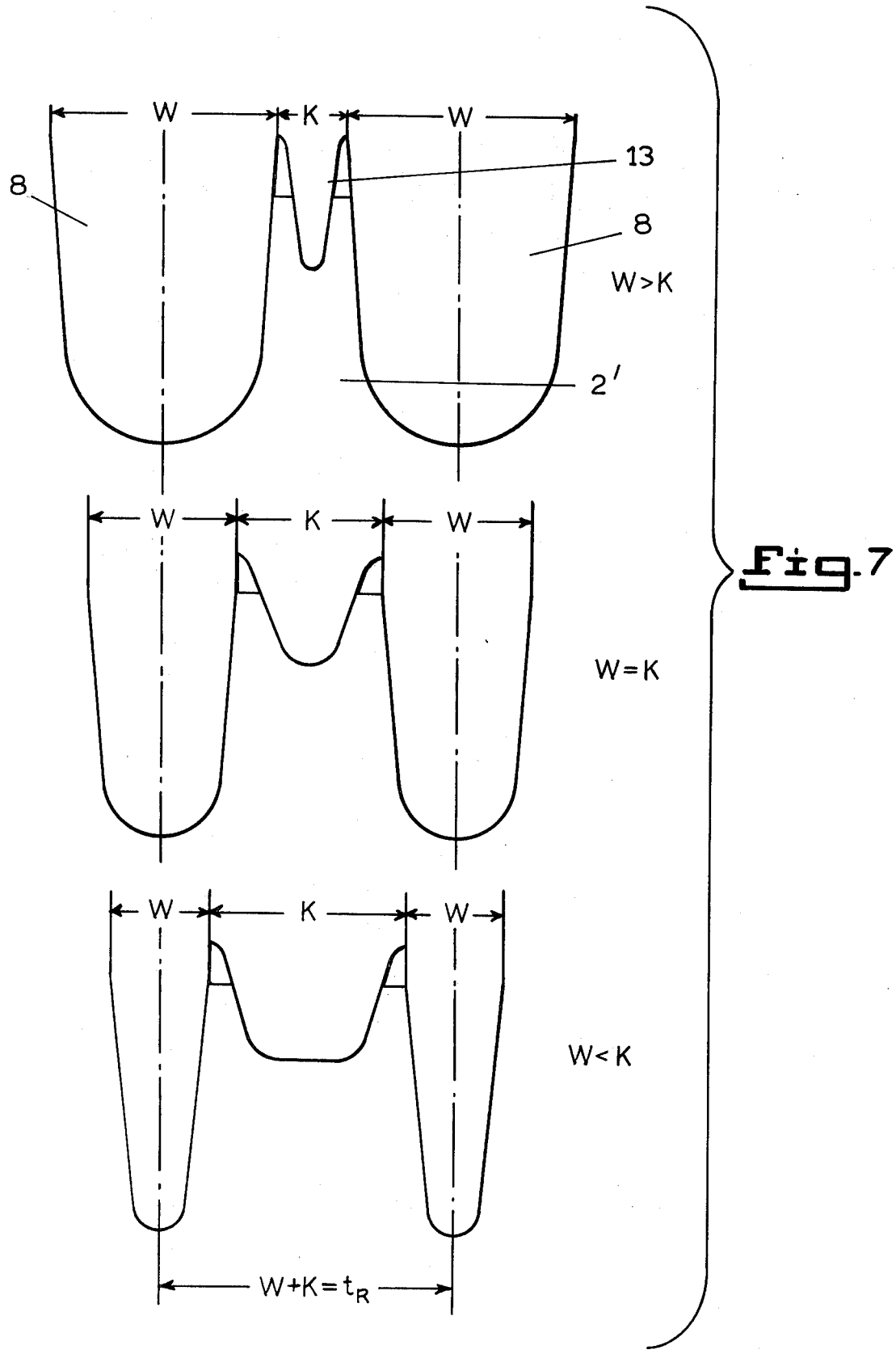
FIG. 7 shows the thickness relationship of the fins as a function of the thickness of the rolling disc and notching roller.

In the above case the thickness W is greater than the thickness K of the notching roller 13 (see FIG. 7). Between the rolling discs 8 there will be notched a relatively thin fin 2'. FIG. 7 shows the case when W equals K and when W is less than K.

A bending roller 14 having a thickness of 1.3 mm follows the last rolling disc. In order that the bending roller 14 can contact the notched fin 2' in the middle there is provided in the above case between the last rolling disc 8 and the bending roller 14 a distance disc 15, so that the distance from the middle of the bending roller 14 to the middle of the last rolling disc corresponds to $1.5\ t_r=1.95$ mm. The diameter of the bending roller 14 is equal to the diameter of the notching roller 13. According to the arrangement shown in FIG. 5, the first bending roller located in tool holder 9 indicated with I has a bending angle $\beta$ of 90°. The second bending roller 14 in tool holder 9 indicated with II has a bending angle $\beta$ of 120°. In the tool holder 9 indicated with III is located a flattening roller. Following the bending roller 14 follows flattening roller 11, there being no correction disc inserted between the two. The diameter of the flattening roller 11 corresponds to the diameter of the bending roller 14 and has a thickness of 1.3 mm.

The rolling discs 8, the notching roller 13, the bending roller 14, the flattening roller 11 are made of high alloy tool steel.

The rolling tools 7 which are adjustable in a radial direction will have a starting speed of 150–400 revolutions per minute and a final speed three to four times greater.

In order to vary the upper crevice width A of the T-finned tube 1, one can change either the diameter and/or the notching angle $\alpha$ of the notching roller 13 or the diameter and/or bending angle $\beta$ of the bending roller 14 for a given radial adjustment of the tool holders 9.

As mentioned, the above described process and apparatus for constructing a T-finned tube can be used for constructing Y-finned tube which will have thermic advantages of the T-tube although the Y-tube will not have the smooth outer surface of the T-tube. The Y-tube will have an additional advantage of being easier to construct than the T-tube since, as will be seen, the process for making the Y-tube is at least one step shorter than the process for making the T-tube.

Figure 8:
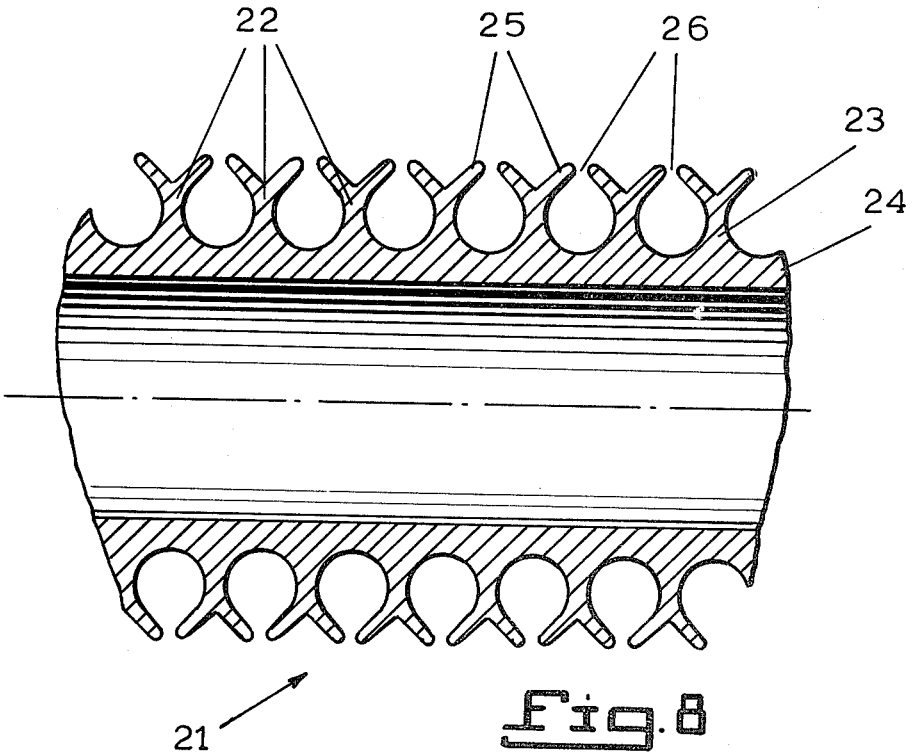
FIG. 8 shows a longitudinal section of the inventive Y-finned tube.

FIG. 8 shows a Y-finned tube 21 having fins 22 running circumferentially in a helical or spiral fashion.

As with the T-tube of FIG. 1, the bases 23 of the fins 22 are extending in the radial direction from the tube wall 24 while the fin ends 25 are forced into a Y-form so that a narrowed crevice 6 is formed.

Figure 9:
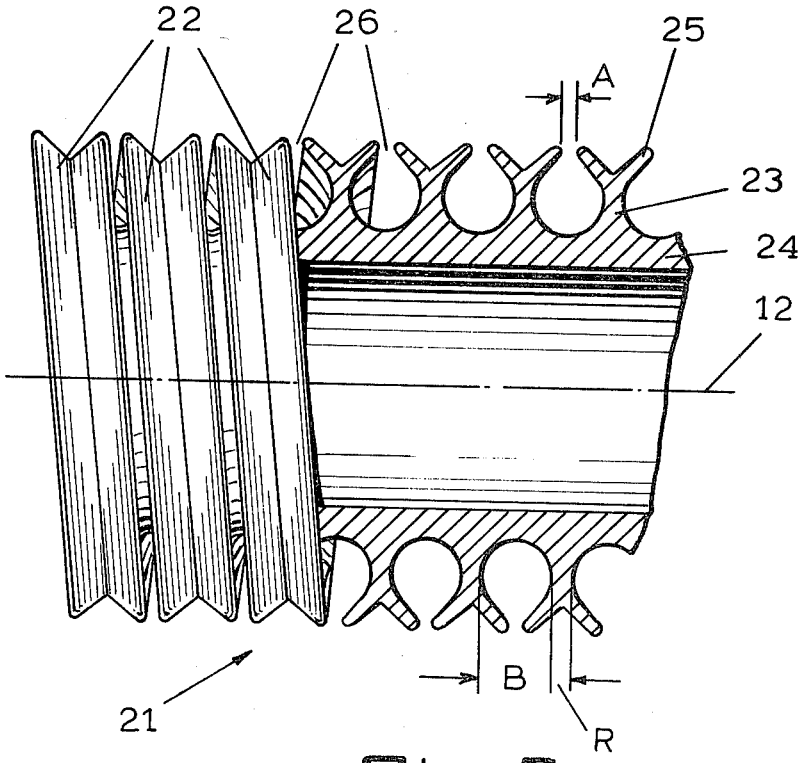
FIG. 9 shows a partial section of the Y-finned tube.

FIG. 9 shows a partial cross section of the Y-tube which corresponds to FIG. 2 for the T-tube.

Figure 10:
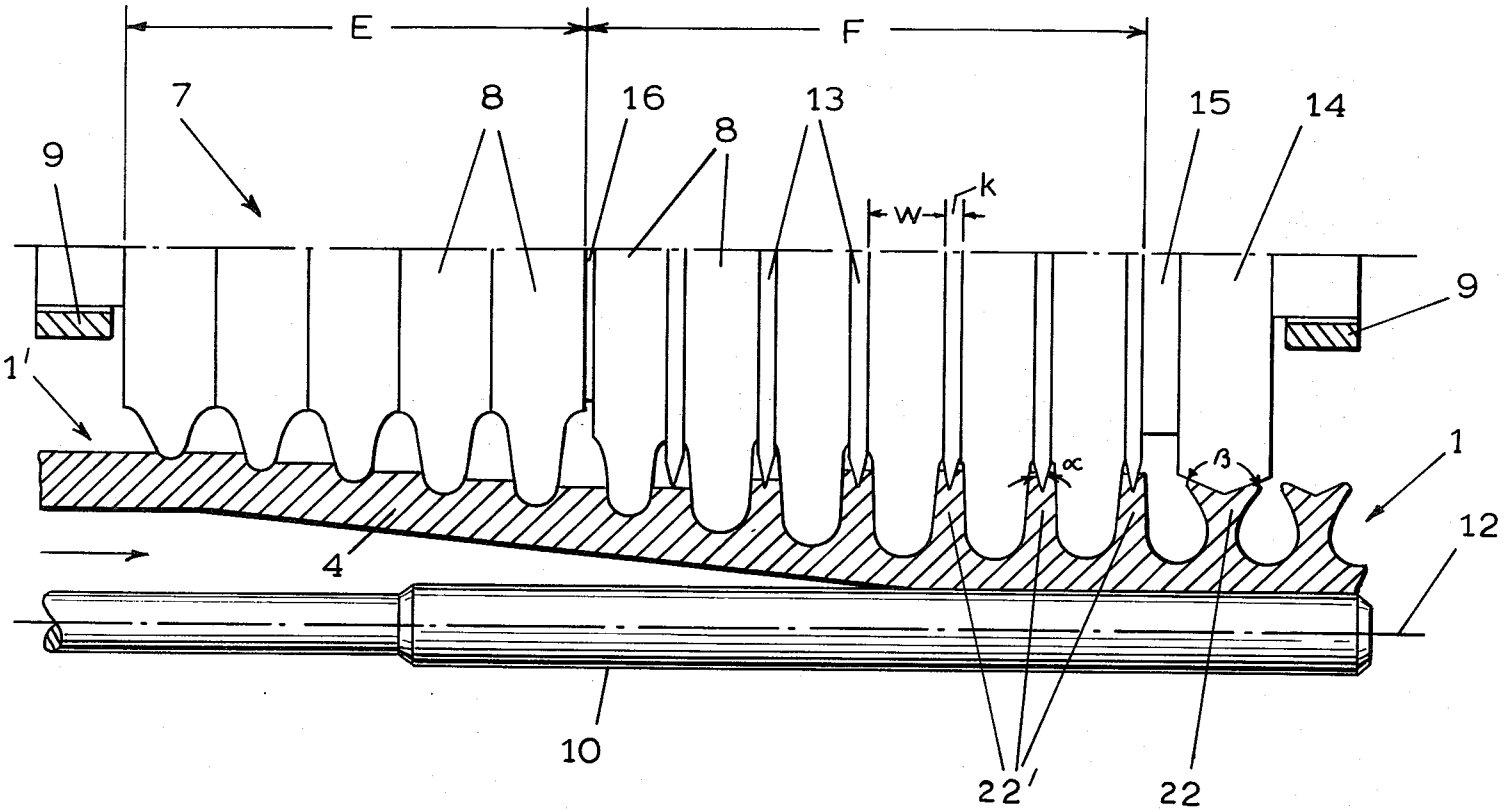
FIG. 10 shows the FIG. 3 apparatus modified for the forming of Y-finned tubes.

FIG. 10 shows a device for making a Y-finned tube which, it will be noted, corresponds to the FIG. 3 device for making T-finned tubes except that the flattening roller 11 seen in FIG. 3 is not included in the device of FIG. 10 since no flattening of the Y-fins takes place. Similarly, as mentioned previously in regard to the T-fins embodiment, where two of the holders 9 would hold bending rollers while the third would hold a flattening roller, in the apparatus of FIG. 10, no flattening roller would be included in the third holder 9 and this third holder could be left without a roller since the two bending rollers would provide the desired Y-form.

FIG. 10, as FIG. 3, shows a rolling tool 7, a bending roller 14, tool holder 9, rolling discs 8 with notching rollers 13, correction disc 16, and distance disc 15.

All dimensions and procedures in regard to the process and apparatus of FIG. 10 would be the same as those of FIG. 3 except, as mentioned, there would be no flattening rollers for flattening the Y-fins into T-fins.

As mentioned, although the apparatus for constructing T and Y-fins functions in regard to the case where the tube rotates while a rolling head is fixedly mounted in relation to the rotating tube, it is, of course, possible to adapt the apparatus so that the tube would not rotate and a rolling head would rotate about the tube.

Figure 11:
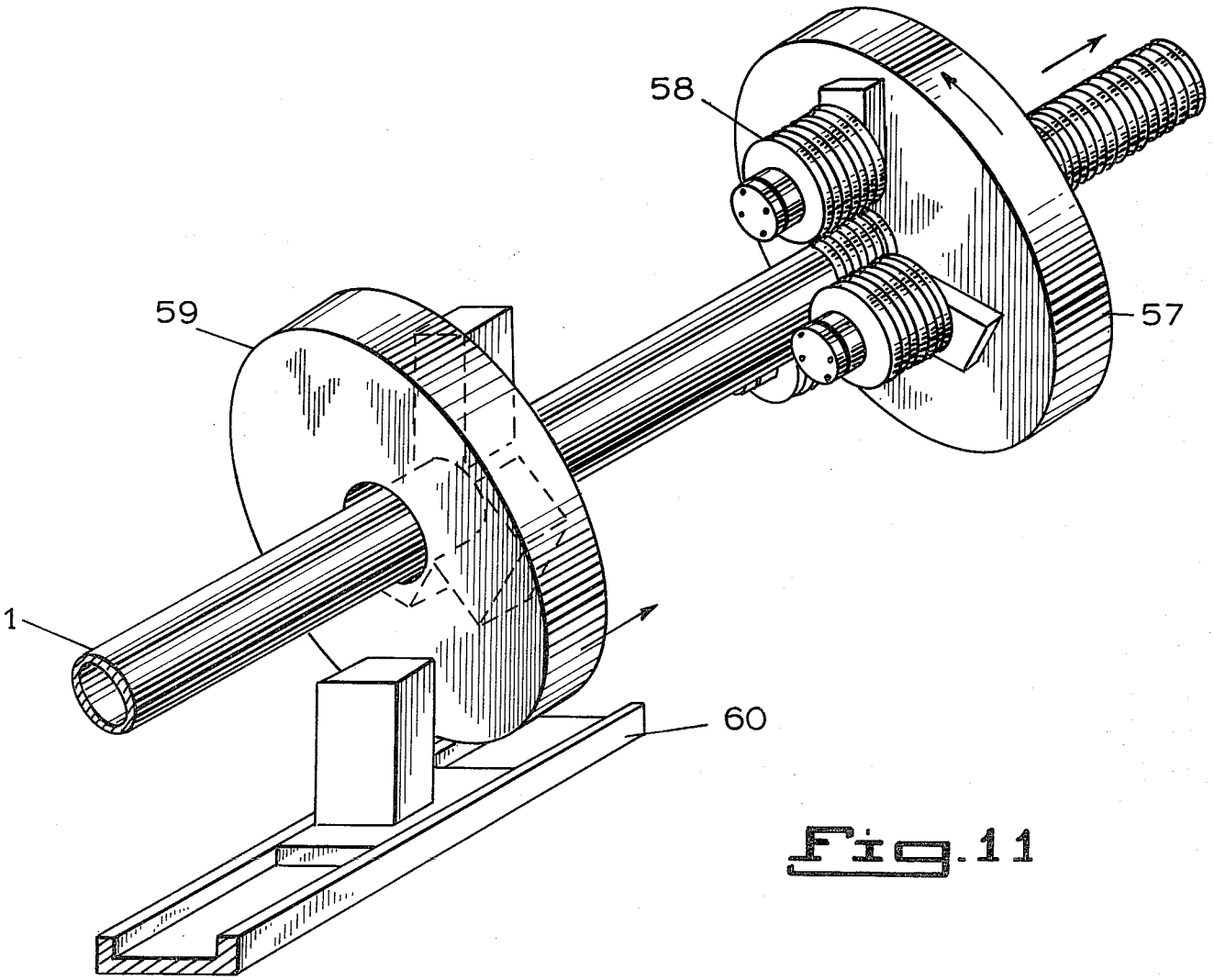
FIG. 11 shows generally a revolving rolling head device with non-rotating tube.

For example, FIG. 11 shows generally the manner in which a rolling head would be constructed with the rolling tools rotating about a non-rotating tube. The tube 1 will be moved in a longitudinal direction as shown by the arrow in the upper right hand corner. Rolling head 57 rotates in the direction shown by the arrow and carries rolling tools 58 which form the fins. The rolling tools 58 are shown only schematically and could be adapted in accordance with the teachings of this invention. The tube 1 does not rotate as it is held in holding clamp 59. Appropriate longitudinal movement is provided by the moving means 60.

Other modifications of the principles of the invention will suggest themselves to those skilled in the art.

We claim:

1. Apparatus for forming fins on a tube outer side, which fins run circumferentially about the tube in a continuous fashion with the outer ends of the fins approaching the outer ends of adjacent fins forming a chamber between adjacent fins, including:

support means for said tube;

rolling disc means for forming a finned tube, said rolling disc means rotating relative to said tube and including a plurality of rolling discs of successively increasing diameters rotating about an axis of said rolling disc means;

means for notching the upper surface of the formed fins, said means for notching including a plurality of notching discs located between at least some of said rolling discs so that the rolling and notching discs are arranged in an alternating sequence.

2. Apparatus according to claim 1, including at least one bending roller means co-axially mounted with said rolling and notching disc means.

3. Apparatus according to claim 2, wherein a distance disc is co-axially mounted between said bending roller and said rolling and notching disc means.

4. Apparatus according to claim 3, wherein a correction disc is co-axially mounted before said notching disc means.

5. Apparatus according to claim 1, wherein the sum $(W+K)$ of the thickness of a rolling disc and an adjacent notching roller corresponds to the fins spacing $t_r$.

6. Apparatus according to claim 5, wherein the thickness W of a rolling disc is greater than the thickness K of a notching roller.

7. Apparatus according to claim 5, wherein the thickness W of a rolling disc is not greater than the thickness K of a notching roller.

8. Apparatus according to claim 5, wherein the diameter of notching discs increases in correspondence with the diameter of the rolling discs.

9. Apparatus according to claim 5, wherein the rolling disc means include a final rolling area F subsequent to an initial rolling area E and wherein the notching discs are arranged in the final rolling area F and wherein the thickness of the rolling discs 8 in the initial area E corresponds to the fins spacing, $t_r$.

10. Apparatus according to claim 9, wherein between the initial area E and the final rolling area F, a correction disc is provided, the thickness of which corresponds to one half the thickness K of a notching disc.

11. Apparatus according to claim 10, wherein the notching discs have the same diameter.

12. Apparatus according to claim 5, wherein the notching angle $\alpha$ of a notching disc corresponds at least to double the flank angle $\gamma$ of the last rolling disc.

13. Apparatus according to claim 2, wherein the middle of the bending roller is arranged at a distance of 1.5 times the fin spacing $t_r$ from the middle of the last rolling disc.

14. Apparatus according to claim 13, wherein a distance disc is arranged between the rolling discs and the bending roller.

15. Apparatus according to claim 2, including a flattening roller means co-axially mounted with said rolling and notching disc means and said bending roller.

16. Apparatus according to claim 15, wherein the thickness of the bending roller and the flattening roller corresponds approximately to the fin spacing $t_r$.

17. Apparatus according to claim 2, wherein said rolling and notching discs are mounted in a tool holder and there are provided three tool holders which are arranged 120° from each other, two of said tool holders having bending rollers.

18. Apparatus according to claim 17, wherein the bending angle $\beta$ of a first bending roller lies between 60° and 100°.

19. Apparatus according to claim 18, wherein the bending angle $\beta$ of a second bending roller lies between 80° and 130°.

20. Apparatus according to claim 19, wherein a third tool holder has a flattening roller, the diameter of which corresponds to the diameter of the last notching disc.

21. Apparatus according to claim 17, wherein there are provided for each tool holder rolling discs and notching discs corresponding to the wished multiplicity of threading of the tube.

22. Apparatus for forming fins on a tube outer side, which fins run circumferentially about the tube in a continuous fashion with the outer ends of the fins approaching the outer ends of adjacent fins forming a chamber between adjacent fins including:

support means for said tube;

rolling disc means for forming a finned tube, said rolling disc means rotating relative to said tube and including a plurality of rolling discs of successively increasing diameters rotating about an axis of said rolling disc means;

means for notching the upper surface of the fins as they are being formed, said notching means including a plurality of notching discs arranged in alternating fashion between said rolling discs;

bending roller means for bending the notched fins into Y-fins;

flattening roller means for flattening the Y-fins into T-fins.

23. Apparatus according to claim 22, including a distance disc co-axially mounted between said bending roller and said rolling and notching disc means.

24. Apparatus according to claim 23, wherein a correction disc is co-axially mounted before said notching disc means.

25. Apparatus according to claim 24, wherein said flattening roller means is co-axially mounted with and follows said rolling and notching discs and said bending roller.

26. Apparatus for forming fins on a tube outer side, which fins run circumferentially about the tube in a continuous fashion with the outer ends of the fins approaching the outer ends of adjacent fins forming a chamber between adjacent fins including:

a plurality of tool holders arranged at the circumference of the tube in staggered relation to each other;

each tool holder including a plurality of alternating rolling and notching discs;

at least one tool holder including a bending roller coaxially mounted with the rolling and notching discs.

27. Apparatus according to claim 26, wherein there are provided three tool holders arranged at 120° from each other, at least two of the said tool holders containing said bending rollers.

28. Apparatus according to claim 26, wherein the tube is non-rotatably mounted in a holding clamp.

29. Apparatus according to claim 26, wherein the tube is rotatably mounted.

30. Apparatus for forming fins on a tube outer side, which fins run circumferentially about the tube in a continuous fashion with the outer ends of the fins approaching the outer ends of adjacent fins forming a chamber between adjacent fins including:

a plurality of tool holders arranged at the circumference of the tube in a staggered relation to each other;

each tool holder including a plurality of alternating rolling and notching discs;

at least one tool holder including a bending roller co-axially mounted with the rolling and notching discs, said bending roller being arranged subsequent to said notching and rolling discs;

at least one tool holder including a flattening roller.

31. Apparatus according to claim 30, wherein said flattening roller is arranged subsequent to said bending roller and co-axial therewith.

32. Apparatus according to claim 30, wherein there is provided three tool holders arranged at 120° from each other, at least two of the said tool holders containing said bending rollers.

33. Apparatus according to claim 30, wherein the tube is non-rotatably mounted in a holding clamp.

34. Apparatus according to claim 30, wherein the tube is rotatably mounted.

35. A process for forming fins on a tube outer side which fins run circumferentially about the tube in a continuous fashion with their outer ends approaching the outer ends of adjacent fins forming a chamber between adjacent fins including the steps of:

displacing the material making up the tube wall in an outward direction by means of a rolling process, said rolling process being carried out by means of rolling discs positioned at the circumference of the tube;

notching the ends of the fins as they are being formed, said notching step being effected by means of a plurality of notching discs co-axially mounted in an alternating fashion with said rolling discs;

bending the ends of the notched fins into Y-fins, said bending step being effected by means of a bending roller mounted subsequent to said rolling and notching discs.

36. A process according to claim 35, including the additional step of flattening said Y-fins into a generally T-form, said flattening step being effected by a flattening roller mounted co-axially with said rolling and notching disc means.

* * * * *

Notice of Adverse Decision in Interference

In Interference No. 100,583, involving Patent No. 4,168,618, M. Saier, H.W. Kastner and R. Klockler, Y AND T-FINNED TUBES AND METHODS AND APPARATUS FOR THEIR MAKING, final judgment adverse to the patentees was rendered Feb. 1, 1982, as to claims 1–6, 8, 17, 21, 26, 27, 29 and 35.

[*Official Gazette June 8, 1982.*]